United States Patent [19]

Smith

[11] 4,157,542

[45] Jun. 5, 1979

[54] ELECTRICAL RECEPTACLE ASSEMBLY WITH PLUG REMOVAL ALARM

[76] Inventor: Patrick W. Smith, 124 Brennan St., Watsonville, Calif. 95067

[21] Appl. No.: 812,132

[22] Filed: Jul. 1, 1977

[51] Int. Cl.[2] ..... G08B 13/02

[52] U.S. Cl. ..... 340/568; 200/51.1; 339/113 R

[58] Field of Search ..... 340/280, 421, 568; 200/51.1; 339/21 R, 113 R

[56] References Cited

U.S. PATENT DOCUMENTS

| | | | |
|---|---|---|---|
| 3,596,265 | 7/1971 | Garland | 340/280 |
| 3,668,601 | 6/1972 | McFarlin | 339/21 R |
| 4,075,617 | 2/1978 | Wireman | 200/51.1 |

*Primary Examiner*—Glen R. Swann, III

*Attorney, Agent, or Firm*—Christie, Parker & Hale

[57] ABSTRACT

An alarm and outlet assembly for use in displaying small appliances and the like comprises a housing defining a plurality of female electrical outlet receptacles. A normally-closed switch is associated with each receptacle and is arranged to be operated into an open state upon engagement of a male electrical connector plug in the corresponding receptacle. Conductors are provided for supplying electrical power to the receptacle and the switches. The switches are defined by a pair of spaced contact conductors in the housing and, for each switch, a movable contact which is spring biased into bridging relation to the contact conductors. Each movable contact is carried on a reciprocable actuator having a head which, in the closed position of the switch, is positioned in the corresponding receptacle to be engaged and depressed by the body of a plug inserted into the receptacle, thus moving the movable contact out of bridging relation to the contact conductors. An alarm is responsive to closure of any of the switches to indicate such event.

4 Claims, 6 Drawing Figures

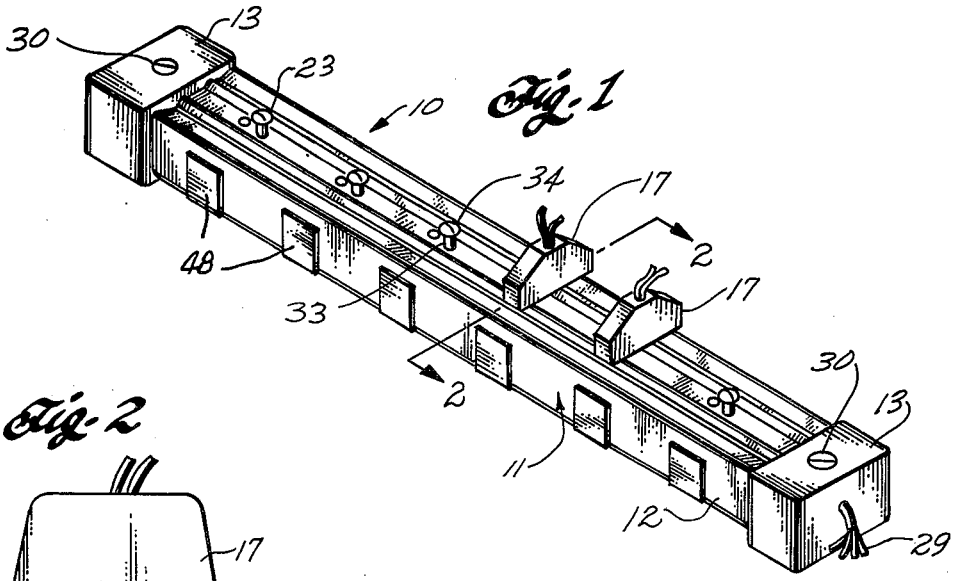
Fig. 1
Fig. 2
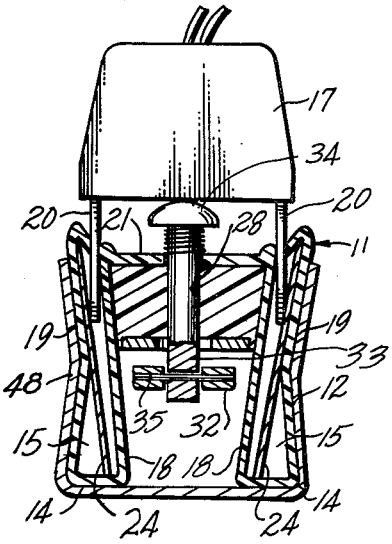
Fig. 4
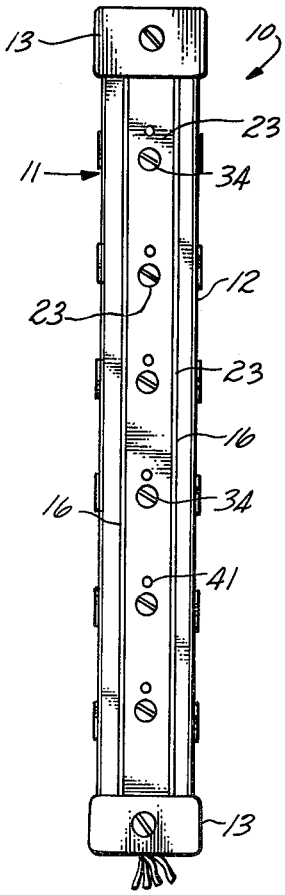
Fig. 3
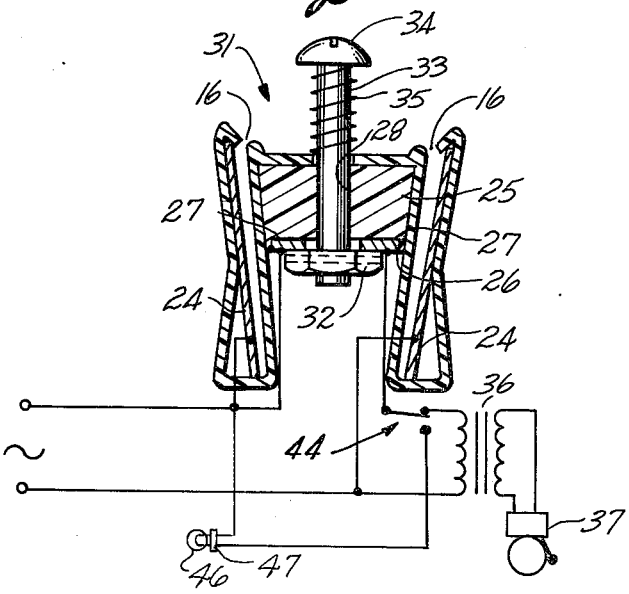

ELECTRICAL RECEPTACLE ASSEMBLY WITH PLUG REMOVAL ALARM

BACKGROUND OF THE INVENTION

1. Field of the Invention

This invention pertains to alarm devices. More particullarly, it pertains to an alarm and outlet assembly useful in displaying small appliances and the like in stores, showrooms and similar locations.

2. Review of the Prior Art

Small electrical appliances, such as radios, clocks, lamps and the like, are often displayed for purposes of sales promotion and other commercial objectives in an operative state. Display of such small appliances in an operative state is desirable so that a prospective purchaser may observe or test the appliance in an actual operating condition. This is particularly the case with lamps, radio alarm clocks, radios, small televisions, and the like, and to a lesser extent with other small appliances such as toasters, mixers, blenders, etc.

It is well known that an increasing portion of small appliances sold in the United States are sold through large retail establishments, including so-called "discount houses", which are of an essentially self-service nature, or in which paid employees are at a minimum, so that goods may be sold at the lowest possible price. In such retail establishments, theft is an unfortunate, but practical reality. Small applicances cannot practically be chained or otherwise fastened into place to discourage theft without sacrificing the article as a salable product; such expedients usually impair the structural integrity or aesthetic characteristics of the product. Similarly, it is not desirable to display small appliances in locked display cabinets or cases; such an approach makes it impossible for the prospective customer to test the product.

A need exists for theft-inhibiting arrangement which enables small appliances to be displayed in an operative state accessible to prospective purchasers, and yet which, upon removal of the small appliance from its display position, activates an alarm to notify authorized personnel that a potential theft of a small appliance has occurred or is occurring. The present invention is addressed to this need.

SUMMARY OF THE INVENTION

The present invention provides a simple, economic, safe, efficient and effective alarm and outlet assembly for use in displaying small electrical appliances and the like in an operative state in commercial and other situations so that the appliances are accessible to prospective purchasers thereof. The assembly is compact, and it is aesthetically unobtrusive to not detract from the display of the appliances themselves. The assmbly provides an alarm signal, visual, audible or otherwise, to alert authorized personnel in the area that a small appliance has been unplugged from the assembly, thereby to signal the fact that a potential theft has occurred or is occurring.

Generally speaking, an alarm and outlet assembly according to this invention comprises a housing and means in the housing which define a plurality of female electrical outlet receptacles, each of which is adapted to releasably receive a male electrical connector plug. A normally-closed switch is associated with each receptacle and is arranged to be operated into an open state upon engagement of a male electrical connector plug in the corresponding receptacle. Means are provided for supplying electrical power to the receptacles and to the switches. Alarm means are responsive to closure of any of the switches to indicate such event.

DESCRIPTION OF THE DRAWINGS

The above-noted and other features of the present invention are more fully set forth in the following detailed description of a presently preferred embodiment of this invention, which description is set forth with reference to the accompanying drawings, wherein:

FIG. 1 is a perspective view of an alarm and outlet assembly according to this invention;

FIG. 2 is a cross-section view taken along line 2—2 of FIG. 1, showing the assembly when an electrical connector plug of a small electrical appliance, for example, is engaged in a receptacle of the assembly;

FIG. 3 is a combination of an energization and alarm circuit schematic diagram and of a view similar to FIG. 2 showing the mechanism of the assembly when the connector plug has been removed from the receptacle;

FIG. 4 is a top plan view of the assembly shown in FIG. 1;

DESCRIPTION OF THE ILLUSTRATED EMBODIMENTS

Figure 5:
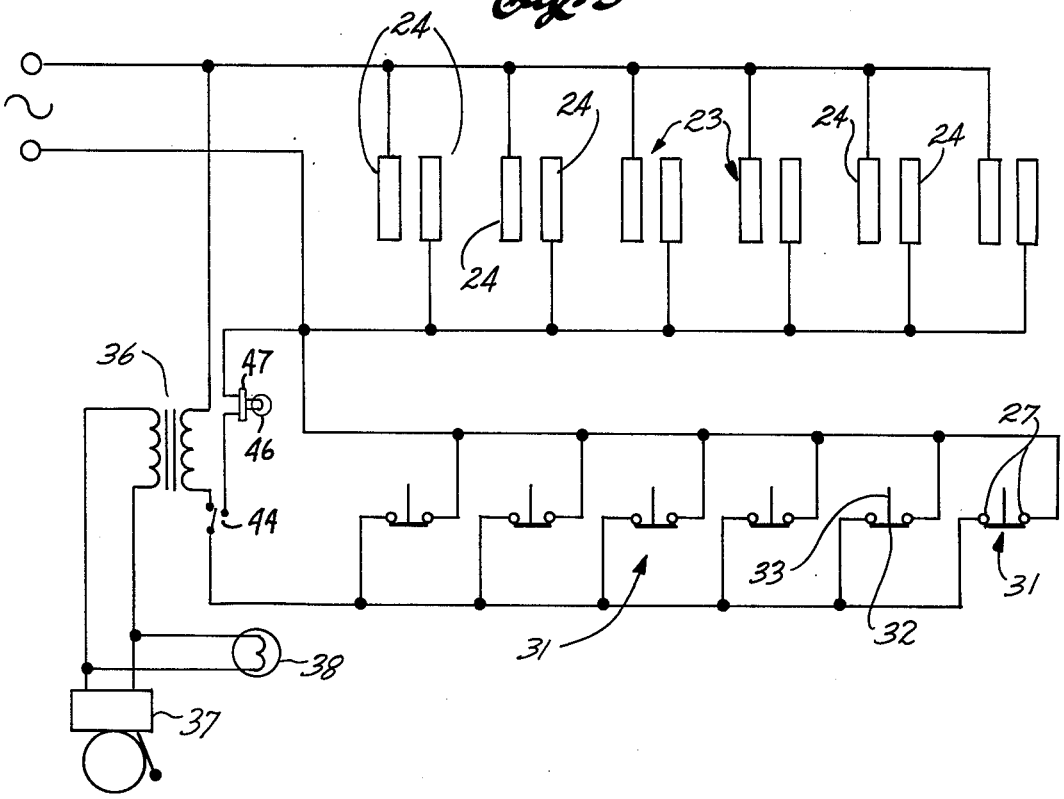
FIG. 5 is a schematic diagram of the electrical circuitry of and associated with the assembly.

As shown in FIGS. 1 and 4, a small appliance alarm and outlet assembly 10 includes an elongate housing 11 which is comprised principally of an elongate body member 12 and end members 13. As shown best in FIGS. 2 and 3, body member 12 can be defined principally by an extrusion of an electrically non-conductive material which, in cross-section, has a configuration resembling an inverted U. Each of the legs 14 of the U-shaped body 12 is hollow to define a chamber 15 therein. Each chamber is open to the exterior of the body through a slot 16 formed in the body at an upper outer surface thereof, as shown best in FIG. 3. Preferably the material from which the body is fabricated is somewhat resilient so that slot 16 is either normally closed or of reduced width in the absence of the engagement of a male electrical connector plug 17 of a small electrical appliance with the assembly as shown in FIG. 2. Accordingly, each chamber 15 in a leg 14 of the body is defined by inner and outer walls 18 and 19, respectively, the outer wall 19 being deflectable by the blades 20 of plug 17 at its upper end to permit the plug blade to be inserted into the adjacent chamber 15. Preferably, as shown in FIGS. 2 and 3, the upper extent of outer wall 19 of each chamber 15 is recurved downwardly toward the upper extent of inner wall 18 for the purpose which is shown in FIGS. 2 and 3 and which is described more particularly below.

Slots 16 extend parallel to each other along the entire elongate extent of body 12 between end members 13. Between these slots, the body defines a substantially flat upper outer surface 21 of the assembly.

Slots 16 and chambers 15 are common components of a plurality of female electrical outlet receptacles 23 which are defined at spaced locations along body 12. The female outlet receptacles are further defined by a pair of sheet-like electrical contact conductors, each of which is disposed in a respective chamber 15 to extend from the bottom of the chamber into the recess formed by the recurved upper extent of the outer wall 19 of the respective chamber. Engagement of the upper edge of each contact conductor 24 within the recess at the upper end of the chamber outer wall serves to retain the conductor in the chamber as a plug 17 is withdrawn from the chamber. Conductors 24 preferably are slid into the chambers through one end of the extruded housing prior to connection of end members 13 to body 12 to define housing 11.

Preferably, as shown in FIG. 2, the inner walls 18 of body legs 14 converge toward each other proceeding downwardly from the upper extent of the body. An electrically non-conductive block 25 is intimately engaged between the inner walls 18 of the body legs at the upper extents of the inner walls. Block 25 may be solvent welded or otherwise suitably affixed to the body. The block has an exposed lower surface 26 between body legs 14. A pair of alarm contact conductors 27, preferably provided as narrow elongate strips of electrically conductive material, are mounted to the lower face of the block, as shown in FIGS. 2 and 3. Conductors 27 are spaced from each other on opposite sides of a series of holes 28 which are formed through the housing from body upper surface 21 to block lower surface 26. Conductors 27 are common to a plurality of switches 31 (see FIG. 5) which are associated with the respective receptacles 23 of assembly 10. The locations of holes 28 define the locations of receptacles 23 along the elongate extent of the housing.

Preferably housing end members 13 are connected to body 12 after receptacle contact conductors 24 have been inserted into the body and after block 25 has been connected to the body. Holes 28 may be defined in the body and in the block either before or after connection of the housing end members to the body. In the course of connecting the housing end members to body 12, appropriate connections of the conductors of a multi-conductor electrical cable 29, associated with one of the housing end members, are made to assembly conductors 24 and 27. Cable 29 is provided for supplying electrical power to the receptacles and switches defined in the housing according to the overall circuit diagram shown in FIG. 5. Preferably each end member 13 is equipped with a screw 30 or other fastener to adapt the assembly to be securely affixed to a supporting surface in an appropriate small appliance display area. It will be observed from the schematic diagram of FIG. 5 that receptacles 23 are connected in electrical parallel to each other, and that the several switches 31 associated with the respective receptacles are also connected in electrical parallel with each other.

As noted above, alarm contact conductors 27 are common to all of switches 31. Each switch includes a movable contact 32 which is movable into and out of bridging and circuit-completing engagement with the alarm contact conductors 27. Each switch also included an actuating mechanism which is coupled to the respective movable contact and which is responsive to engagement of a connector plug 17 in the associated receptacle 23 for moving the movable contact 32 out of bridging engagement with the alarm contact conductors. The actuating member preferably is comprised of a pin 33 which is reciprocally mounted in a corresponding hole 28 to extend through upper surface 21 of the housing. The upper end of each pin defines a head 34 which is engageable with the surface of a male connector plug 17 between the plug contact blades 20 as the plug is engaged with the corresponding receptacle; see FIG. 2. Each switch 31 also includes a spring 35 coupled to the actuator pin for biasing the pin into a position in which the movable contact 32, carried by the opposite end of the pin, is moved into bridging engagement with alarm contact conductors 27. As shown in FIGS. 2 and 3, spring 35 preferably is engaged circumferentially of the pin between the head of the pin and the upper surface 21 of the housing body, thereby to define a normally-closed switch 31 in association with each receptacle 23 of assembly 10. As shown in the drawings, actuator pin 33 can be defined by a machine bolt which is unthreaded along a major portion of its length. The movable contact 32 of each switch can be defined by a nut, having a hole oversized relative to the bolt (see FIG. 2), and pivotally connected to the pin 33 by a small transverse pin 35 (such as a roll pin) snugly engaged in a hole diametrically through the nut and passing through an oversize hole formed diametrically through the pin 33, as shown in FIG. 2; the pivotal connection of nut 32 to actuator pin 33 assures that the nut can move on the pin to always make electrical contact with both of alarm contact conductors 27 when the switch is closed. The head of the bolt defines head 34 of the actuator pin.

In view of the foregoing description, and particularly in view of the illustrations of FIGS. 2, 3 and 5, it will be seen that switches 31 are connected in an electrical parallel circuit relation with each other. This circuit also includes an alarm which is responsive to closure of any of switches 31 to signal to appropriate personnel that an appliance, previously plugged into assembly 10 has been removed, which event corresponds to a theft of the appliance. As shown in FIG. 5, the alarm includes a voltage reducing transformer 36 having a primary winding in circuit with switches 31 in such a manner that current flows, via a selector switch 44, through the primary winding upon closure of any one of switches 31. The alarm includes a bell 37 connected across the secondary winding of transformer 36 and, either alternatively or in addition to the bell, a signal lamp 38. Other alarm mechanisms may be connected in circuit relation with the switches if desired. Other suitable alarm mechanisms might be a burglar alarm, or a telephone dialing device arranged to dial the local police department in the event that a switch 31 is closed at a time other than normal business hours of the user of assembly 10.

Selector switch 44 is connected in series with the primary winding of transformer 36 and is operable for selecting between the above-described alarm and an indicator lamp 46 which, when selected by switch 44, is connected in parallel with receptacle contact conductors 24. The presence of switch 44 in the circuitry for assembly 10 allows an authorized sales or other person to disable the theft-indicating alarm to permit appliances to be disconnected from or plugged into the assembly, as when an appliance display is being altered. The indicator lamp 46 preferably is located in the store, e.g., at a visible location where it normally cannot be reached, thus preventing sales personnel from unscrewing the indicator lamp bulb. Preferably, the indicator lamp is red and is driven by a flasher circuit 47. Thus, when the alarm system is disabled by anyone, the flashing indicator lamp 46 is activated to indicate that the alarm has been disabled.

Figure 6:
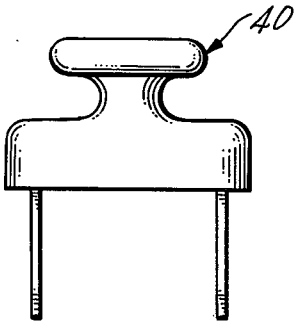
FIG. 6 is an elevation view of a dummy electrical connector plug useful with the assembly.

There may be situations in which a user of assembly 10 desires not to connect electrical appliances to all of the outlet receptacles defined in the assembly while retaining the alarm feature of the assembly. In such a case, it is necessary to disable the switches associated with the receptacles to which appliances are not connected. Accordingly, this invention provides dummy electrical connector plugs 40, shown in FIG. 6. The dummy plugs have no electrical conductors associated with them, but define replicas of the contact blades of an electrical plug so that, upon insertion of a dummy plug into a receptacle 23, the switch associated with that receptacle is operated into its open state in the manner described above.

As shown in FIGS. 1 and 4, a hole 41 preferably is formed through housing 20 parallel to and adjacent to the hole 28 for each switch actuator pin 33. Holes 41 are provided to accommodate the ground pin of a three-prong grounded male electrical connector plug. If desired, suitable contacts may be provided in association with each of holes 41 to make electrical contact with the ground pin of a three-prong plug engaged in the corresponding receptacle. Assembly 10, therefore, is capable of accommodating both grounded and ungrounded electrical connector plugs provided as components of small electrical appliances. Holes 41 are located in such cooperation with the switches 31 that, upon engagement of a grounded male electrical plug into the associated hole 41, the adjacent switch actuator pin will be engaged by a portion of the plug, thereby to operate the corresponding switch 31 into its open state.

To assure that receptacle contact conductors 24 are always biased toward each other sufficiently to make contact with the blades 20 of a plug either as it is inserted into a receptacle 23 or after it has been inserted, a biasing clip 48 can be engaged with body 12 adjacent each receptacle. Each biasing clip is made of a resilient metal and is of U-shaped configuration. The adjacent legs of the clip normally are spaced a distance less than the distance between the outer side surfaces of the body. The clips are engaged with the body from the underside of the body and when connected to the body, as shown in FIGS. 1 and 2, bias the outer walls 19 of chambers 15 toward each other to dispose conductors 24 in the path of plug blades 20. In this way, a plug 17 engaged with the assembly is prevented from coming loose and setting off the theft-indicating alarm.

In view of the foregoing description, it will be apparent that this invention provides a simple, effective and efficient alarm and outlet assembly useful, as by retailers and other displayers of small electrical appliances, to display the appliances in an operative mode accessible to members of the public, and yet which inherently serves to discourage theft of the appliances. Upon disconnection of any appliance from the assembly, the switch 31 associated with the outlet receptacle to which the appliance was connected will close automatically, thereby operating the appropriate alarm mechanism. The existence of the alarm mechanism is normally not visible in assembly 10 during normal use of the assembly. This is so because the switches are hidden by the plugs of the appliances connected to the assembly or by dummy plugs 40. Therefore, a potential thief is not readily informed that an alarm will be sounded upon removal of the appliance plug from the assembly. The potential thief, therefore, is not informed to try to maintain the switch actuator pin in its depressed state as plug 17 is removed from the housing receptacle.

The multi-receptacle assembly 10 described above is the presently preferred embodiment of the present invention. The invention can be and has been incorporated into single-receptacle arrangements which can be installed in place of conventional wall outlets in residences, stores, hotels and the like. Thus, this invention can be used in hotels and motels to counteract theft of television sets, for example. When used in a hotel or motel, the theft-indicating alarms for each of the several rooms can be located in an office area to indicate the particular room in which an event has occurred to activate an alarm.

It will be apparent to workers in the art to which this invention pertains that an outlet and alarm assembly according to this invention may take forms different from the particular preferred form illustrated in the accompanying drawings. An alarm and outlet assembly according to this invention may be constructed using existing commercially available electrical connector receptacles and switches, if desired. It is believed, however, that the arrangement described and illustrated above lends itself to economy of manufacture in view of its structural simplicity and its use of commercially available parts, such as machine bolts and nuts, as components of switches 31. Accordingly, the scope of this invention should not be limited only to the specific arrangement illustrated and described.

What is claimed is:

1. An alarm and outlet assembly for use in displaying small appliances and the like comprising a housing, means in the housing defining in an outer face of the housing a plurality of female electrical outlet receptacles each adapted to releasably receive a male electrical connector plug, a normally-closed switch associated with each receptacle and arranged to be operated into an open state upon engagement of a male electrical connector plug in the corresponding receptacle, the switches being comprised of a pair of spaced alarm contact conductors in the housing and, for each switch, a movable contact movable out of and into bridging engagement with the alarm contact conductors, and actuating means coupled to each movable contact responsive to engagement of a male connector plug in the associated receptacle for moving the movable contact out of bridging engagement with the alarm contact conductors, and biasing means biasing each movable contact into bridging engagement with the alarm contact conductors.

2. Apparatus according to claim 1 wherein each actuating means comprises a pin mounted in the housing between the alarm contact conductors for reciprocation along a line normal to said outer face of the housing, the pin having one end thereof projecting beyond said outer face for contact with and reciprocable operation by a male connector plug engaged in the associated receptacle, the other end of the pin carrying the movable contact, and the biasing means comprises spring means coupled to the pin for biasing it into a position along its path of reciprocable movement in which the movable contact is in bridging engagement with the alarm contact conductors and the one end of the pin is extended from sad outer face of the housing.

3. Apparatus according to claim 2 including means movably mounting the movable contact to the pin.

4. Apparatus according to claim 1 wherein the receptacles are comprised of a pair of parallel slots defined in the outer surface of the housing, and a contact conductor disposed in the housing in association with each slot to define a wall of the slot in the housing, and wherein the alarm contact conductors are disposed parallel to and between the slots.

* * * * *